US010305223B2

(12) United States Patent
Tashiro et al.

(10) Patent No.: US 10,305,223 B2
(45) Date of Patent: May 28, 2019

(54) CONNECTOR WITH PROJECTING SUB-CONNECTOR LANCE

(71) Applicant: YAZAKI CORPORATION, Tokyo (JP)

(72) Inventors: Akinori Tashiro, Shizuoka (JP); Yoshihiro Iwahori, Shizuoka (JP); Tomoyuki Kasajima, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/784,305

(22) Filed: Oct. 16, 2017

(65) Prior Publication Data

US 2018/0109033 A1 Apr. 19, 2018

(30) Foreign Application Priority Data

Oct. 17, 2016 (JP) ..... 2016-203461

(51) Int. Cl.
*H01R 13/514* (2006.01)
*H01R 13/629* (2006.01)
(Continued)

(52) U.S. Cl.
CPC ... *H01R 13/62927* (2013.01); *H01R 13/4223* (2013.01); *H01R 13/501* (2013.01);
(Continued)

(58) Field of Classification Search
CPC .. H01R 13/514; H01R 13/4362; H01R 13/62; H01R 13/6397; H01R 13/501;
(Continued)

(56) References Cited

U.S. PATENT DOCUMENTS 5,681,184 A * 10/1997 Pamart ..... H01R 13/4362 439/310
5,888,081 A 3/1999 Konoya et al.
(Continued)

FOREIGN PATENT DOCUMENTS

CN 1175804 A 3/1998
CN 1171358 C 10/2004
(Continued)

OTHER PUBLICATIONS

An office action dated Jan. 8, 2019 in a counterpart Japanese patent application.

(Continued)

*Primary Examiner* — Hae Moon Hyeon
(74) *Attorney, Agent, or Firm* — Metrolexis Law Group, PLLC

(57) ABSTRACT

A connector includes a housing having a sub-connector accommodation hole passing through in a forward and backward direction, and a sub-connector having a cavity passing through in the forward and backward direction and assembled by being inserted into the sub-connector accommodation hole of the housing from a backward direction while a terminal connected to a wire being inserted into the cavity. A lance with flexibility to be locked with the terminal is formed on an inner wall of the cavity and in a case of halfway insertion of the terminal into the cavity. The lance projects outward from the sub-connector to abut, at an angle, against an opening exterior edge of the sub-connector accommodation hole.

6 Claims, 22 Drawing Sheets

(51) Int. Cl.

| | |
|---|---|
| ***H01R 13/50*** | (2006.01) |
| ***H01R 13/502*** | (2006.01) |
| ***H01R 13/422*** | (2006.01) |
| ***H01R 13/516*** | (2006.01) |
| *H01R 13/453* | (2006.01) |

(52) U.S. Cl.
CPC ..... *H01R 13/502* (2013.01); *H01R 13/516* (2013.01); *H01R 13/4538* (2013.01); *H01R 13/62938* (2013.01)

(58) Field of Classification Search
CPC ..... H01R 13/502; H01R 13/516; H01R 13/4223; H01R 13/62927; H01R 33/3397
USPC ..... 439/752, 304, 352, 357, 372
See application file for complete search history.

(56) References Cited

U.S. PATENT DOCUMENTS

| | | | | |
|---|---|---|---|---|
| 7,686,647 | B1 * | 3/2010 | Hong | H01R 9/0518 439/595 |
| 2002/0182908 | A1 | 12/2002 | Maegawa | |
| 2006/0183376 | A1 * | 8/2006 | Shamoto | H01R 13/4223 439/595 |
| 2009/0042438 | A1 * | 2/2009 | Iwahori | H01R 13/4365 439/521 |
| 2010/0009568 | A1 * | 1/2010 | Ichio | H01R 13/4223 439/507 |
| 2014/0120759 | A1 | 5/2014 | Suzuki | |
| 2015/0349460 | A1 * | 12/2015 | Fukaya | H01R 13/4223 439/345 |
| 2016/0240969 | A1 | 8/2016 | Matsuura et al. | |
| 2018/0083380 | A1 * | 3/2018 | Goto | H01R 13/4223 |

FOREIGN PATENT DOCUMENTS

| | | | |
|---|---|---|---|
| CN | 103794920 | A | 5/2014 |
| CN | 106340758 | A | 1/2017 |
| JP | 2002-352907 | A | 12/2002 |
| JP | 2004-200180 | A | 7/2004 |
| JP | 2008-270152 | A | 11/2008 |
| JP | 2014-89808 | A | 5/2014 |
| JP | 2015-49964 | A | 3/2015 |
| JP | 2016-152062 | A | 8/2016 |

OTHER PUBLICATIONS

The Japanese office action dated Aug. 21, 2018 in a counterpart Japanese Patent application.
Office action issued Feb. 15, 2019, in a counterpart Chinese patent application.

* cited by examiner

CONNECTOR WITH PROJECTING SUB-CONNECTOR LANCE

CROSS REFERENCE TO RELATED APPLICATIONS

This application claims the priority of Japanese Patent Application No. 2016-203461, filed on Oct. 17, 2016, the entire content of which are incorporated herein by reference.

BACKGROUND

Technical Field

The present invention relates to a connector such as a lever type connector in which male and female housings are fitted and detached by a reciprocation operation of a lever using a weak insertion force.

Related Art

This kind of connector includes one disclosed by JP 2008-270152 A.

This connector 1 is, as shown in FIGS. 22 and 23, a male connector and includes a male housing 2 having a hood portion 2*a* and a sub-housing accommodation chamber 2*b* passing through in a forward and backward direction, a lever 3 rotatably supported by the male housing 2 via a spindle (not shown), a male sub-housing 4 having a plurality of cavities 4*a* accommodating and holding a male terminal 5 and accommodated in the sub-housing accommodation chamber 2*b*, a retainer 6 inserted into a retainer mounting hole 4*b* formed in the male sub-housing 4 to doubly lock the male terminal 5 together with a lance 4*c*, and a moving plate 7 having a cam follower 7*a* engaged with a cam groove 3*a* of the lever 3 and a positioning hole 7*b* that positions a tab portion 5*a* of the male terminal 5.

Then, the moving plate 7 and a female connector (not shown) are integrally drawn by a cam action of engagement of the cam groove 3*a* of the lever 3 and the cam follower 7*a* of the moving plate 7 to a back side in the hood portion 2*a* of the male housing 2 so that both connectors are fitted.

SUMMARY

In the connector 1 of conventional type, however, as shown in FIG. 23, double locking and halfway insertion of the male terminal 5 assembled to the cavity 4*a* of the male sub-housing 4 are detected by the retainer 6 so that the number of components increases and the cost rises correspondingly.

Thus, the present invention is made to solve the above problem and an object thereof is to provide a connector capable of detecting double locking of a terminal assembled to a sub-housing by a housing and halfway insertion of the terminal.

A connector according to an aspect of the present invention includes a housing having a sub-connector accommodation hole passing through in a forward and backward direction, and a sub-connector having a cavity passing through in the forward and backward direction and assembled by being inserted into the sub-connector accommodation hole of the housing from a backward direction while a terminal connected to a wire being inserted into the cavity. A lance with flexibility to be locked with the terminal is formed on an inner wall of the cavity and in a case of halfway insertion of the terminal into the cavity. The lance projects outward from the sub-connector to abut, at an angle, against an opening exterior edge of the sub-connector accommodation hole.

When insertion of the terminal into the cavity is completed, an undersurface of the lance may be on the same surface with a surface of an inner wall of the sub-connector accommodation hole, and when insertion of the terminal into the cavity is halfway, the undersurface of the lance may project outward from an outer circumferential surface of the sub-connector.

The connector may further include a male housing as the housing to accommodate and hold a male terminal as the terminal and having a hood portion, a lever rotatably supported by the housing via a spindle, a moving plate that positions a tab portion of the male terminal inside the hood portion, and a female housing as the housing to accommodate and hold the male terminal as the terminal and fitted into or detached from the hood portion. The lever may be caused to perform a forward movement operation while a cam follower formed in the female housing is fitted into a cam groove formed in the lever to move the female housing to a back side in the hood portion together with the moving plate to be freely fitted into the male housing and a groove portion for temporarily locking the lever may be formed in the hood portion and the groove portion is used as a guiderail for moving the moving plate.

A length of a male sub-connector as the sub-connector may be set longer than that of a male terminal as the terminal.

A locking portion with flexibility to be locked with a male sub-connector as the sub-connector may be formed on an inner wall of the sub-connector accommodation hole of the male housing and a control portion that inhibits a forward movement operation of the lever by the lever being made lockable/detachable may be formed on a free end side of the locking portion.

As described above, a connector according to an aspect of the present invention can detect double locking of the terminal assembled to the sub-housing by the housing and halfway insertion of the terminal by forming the lance with flexibility to be locked with the terminal on the inner wall of the cavity of the sub-connector and in the case of halfway insertion of the terminal into the cavity, the lance is made to abut, at an angle, against the opening exterior edge of the sub-connector accommodation hole of the housing by being projected outward from the sub-connector. Accordingly, a separate component for double locking of the terminal such as a conventional retainer is no longer needed so that lower costs can be achieved by reducing the number of components.

If the undersurface of the lance is in the same plane with the surface of the inner wall of the sub-connector accommodation hole when the insertion of the terminal into the cavity is completed and the undersurface of the lance is projected outward from an outer circumferential surface of the sub-connector in the case of halfway insertion of the terminal into the cavity, double locking of the terminal assembled to the sub-housing by the housing and halfway insertion of the terminal can easily and reliably be detected.

If the groove portion for temporarily locking the lever is formed in the hood portion and the groove portion is set as a guiderail when the moving plate is moved, the groove portion for temporarily locking the lever can be used as a guiderail of the moving plate when the moving plate is mounted or the lever is operated so that the lever type connector can be reduced in size and also assemblability of the moving plate and operability of the moving plate can be improved.

If the male sub-connector as a sub-connector is set longer than the male terminal, the tip of the male sub-connector reaches the tip of the female sub-connector earlier than the terminal even if the female housing is inserted into the hood portion of the male housing obliquely or in a direction in which prying is caused and so the occurrence of prying can be inhibited. Also, the male sub-connector serves as a guide of the female housing when the male and female housings are fitted and so the prying inhibition function and the guide function can be imparted while reducing the cost.

If the locking portion with flexibility to be locked with the male sub-connector as a sub-connector is formed on the inner wall of the sub-connector accommodation hole of the male housing and the control portion that can be fitted into and detached from the lever and inhibits the forward movement operation of the lever is formed on the free end side of the locking portion, the movement of the lever can be inhibited by the control portion of the locking portion when the male sub-connector is halfway inserted into the sub-connector accommodation hole of the male housing. Accordingly, a half fitted state of the male sub-connector and wrong connector fitting can easily and reliably be detected without adding any component.

DETAILED DESCRIPTION

Hereinafter, an embodiment of the present invention will be described based on the drawings.

Figure 1:
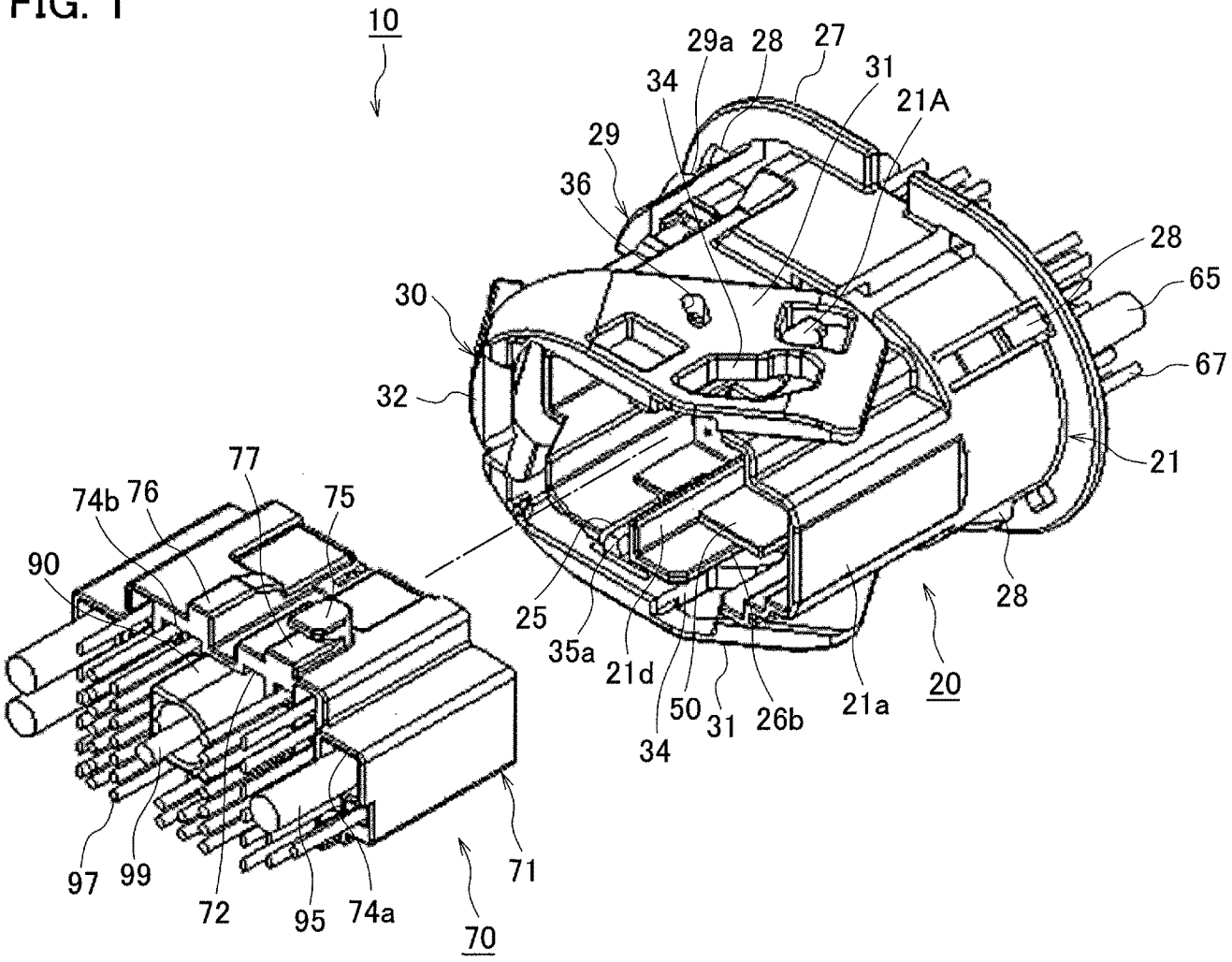
FIG. 1 is a perspective view before connectors according to an embodiment of the present invention are fitted.
Figure 2:
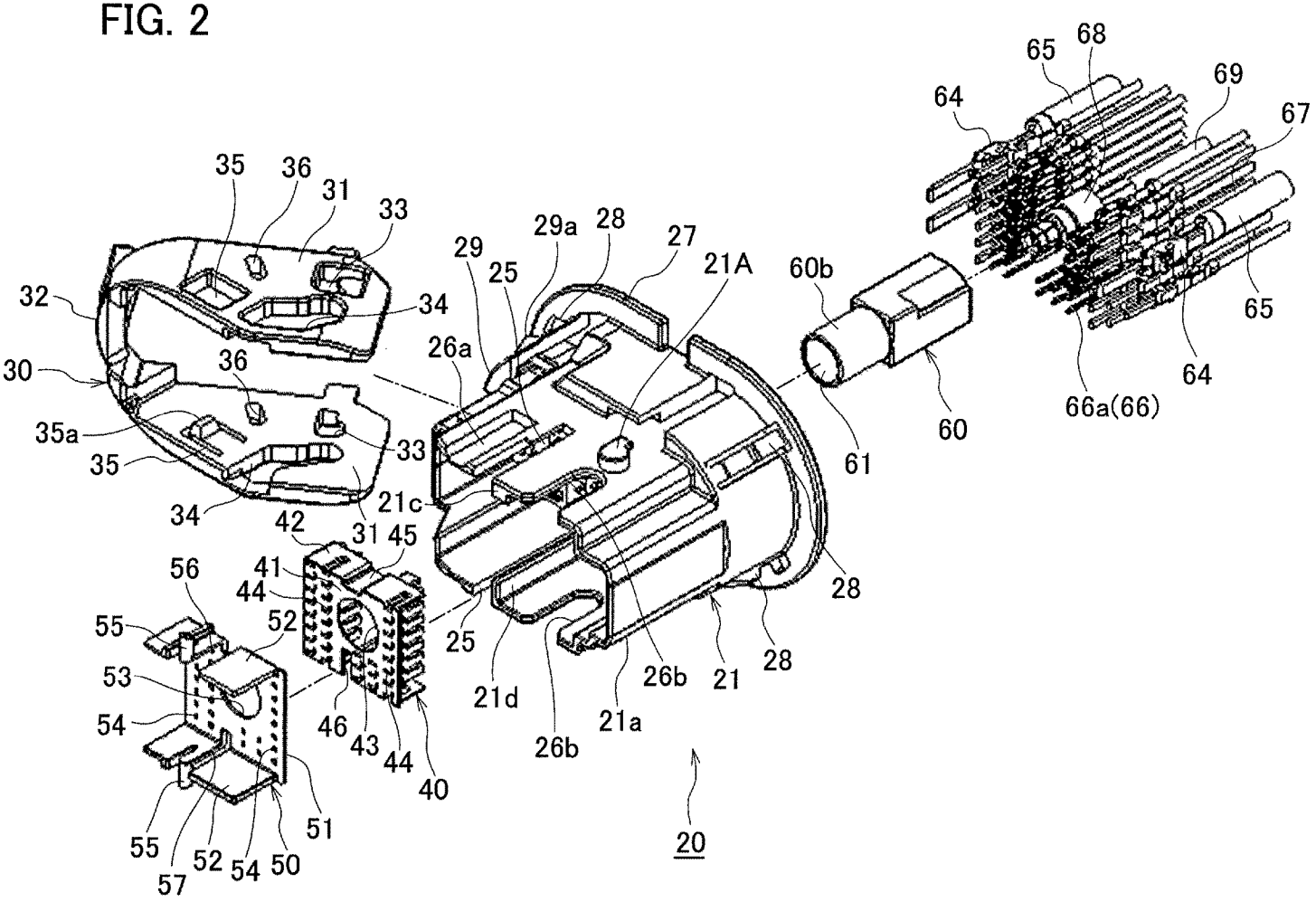
FIG. 2 is an exploded perspective view of a male connector of the connectors according to the present embodiment.
Figure 3:
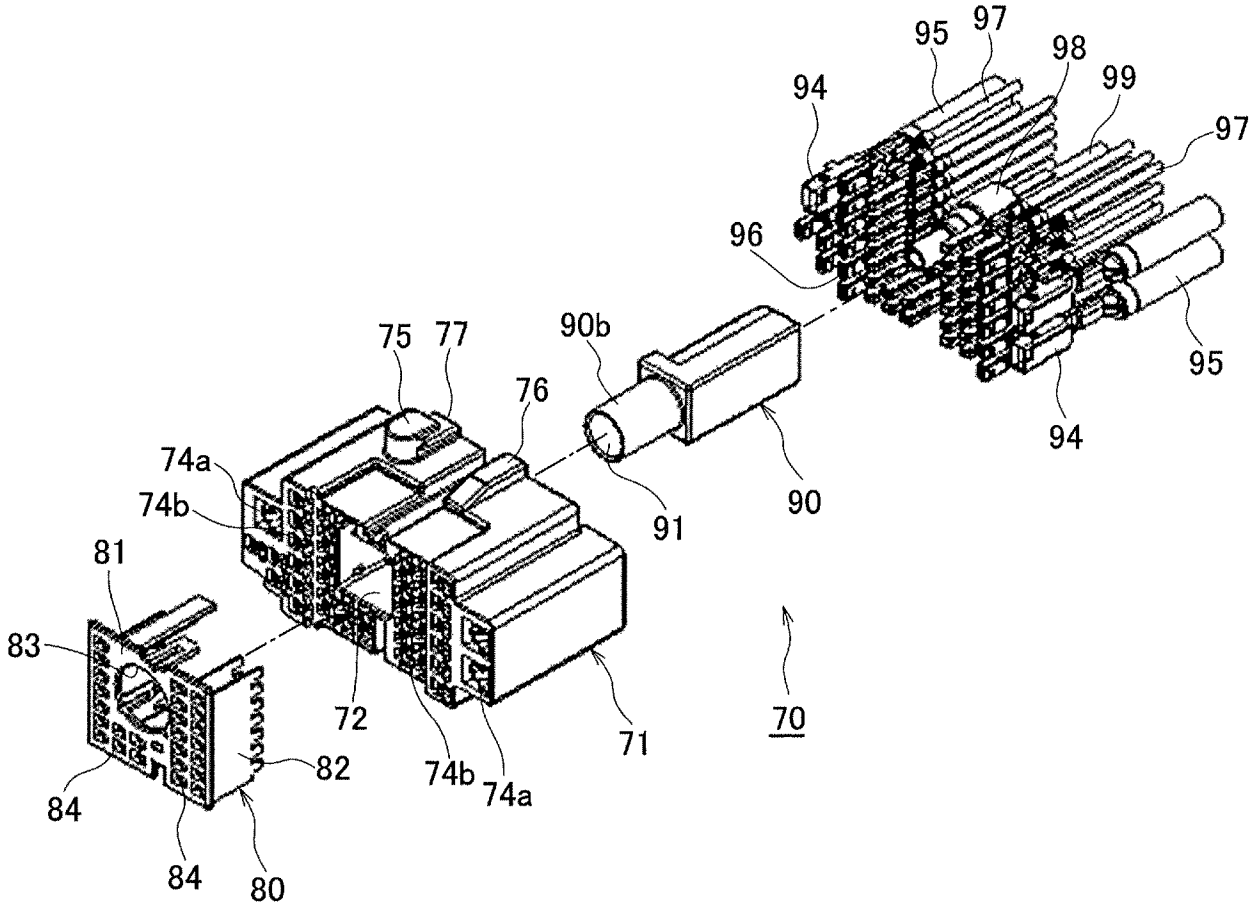
FIG. 3 is an exploded perspective view of a female connector of the connectors according to the present embodiment.
Figure 4:
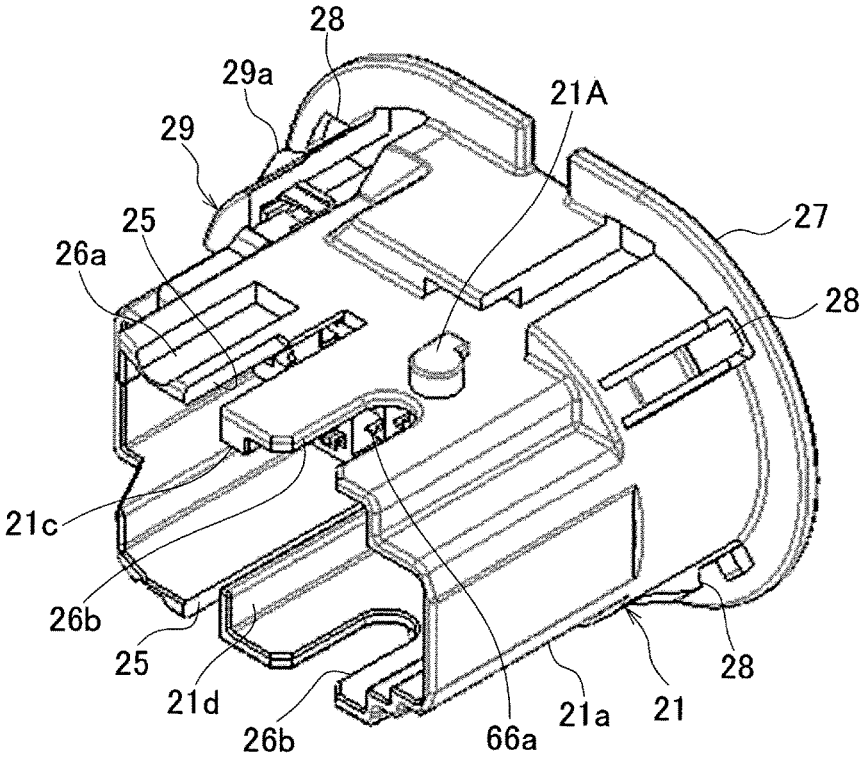
FIG. 4 is a perspective view of a housing of the male connector according to the present embodiment.
Figure 5:
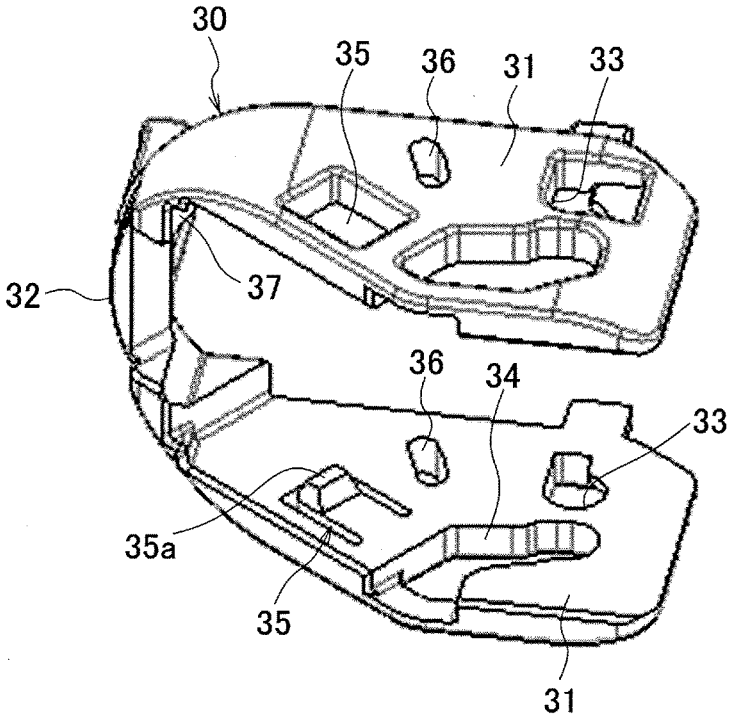
FIG. 5 is a perspective view of a lever of the male connector according to the present embodiment.
Figure 6:
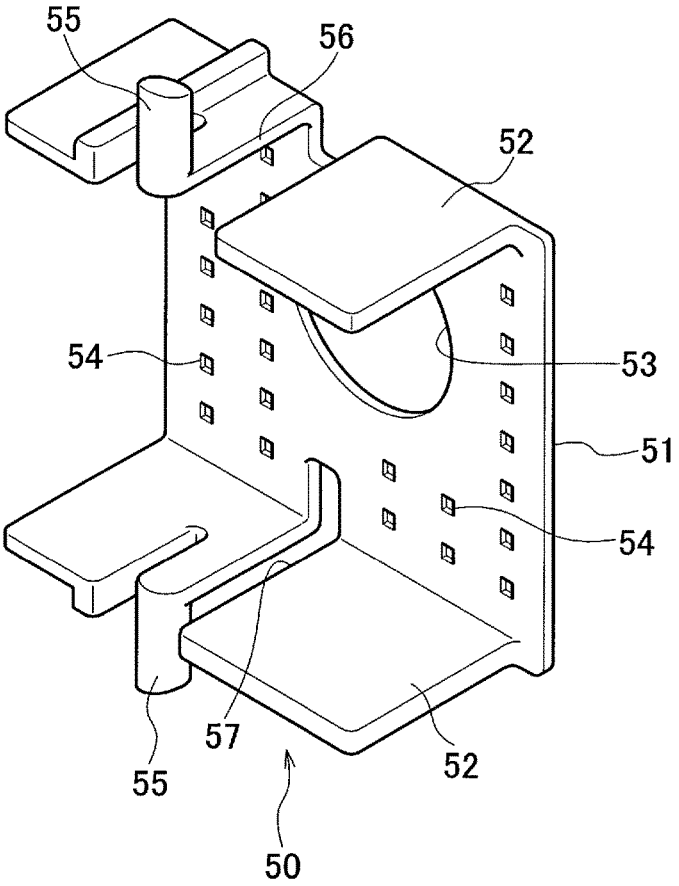
FIG. 6 is a perspective view of a moving plate of the male connector according to the present embodiment.
Figure 7A:
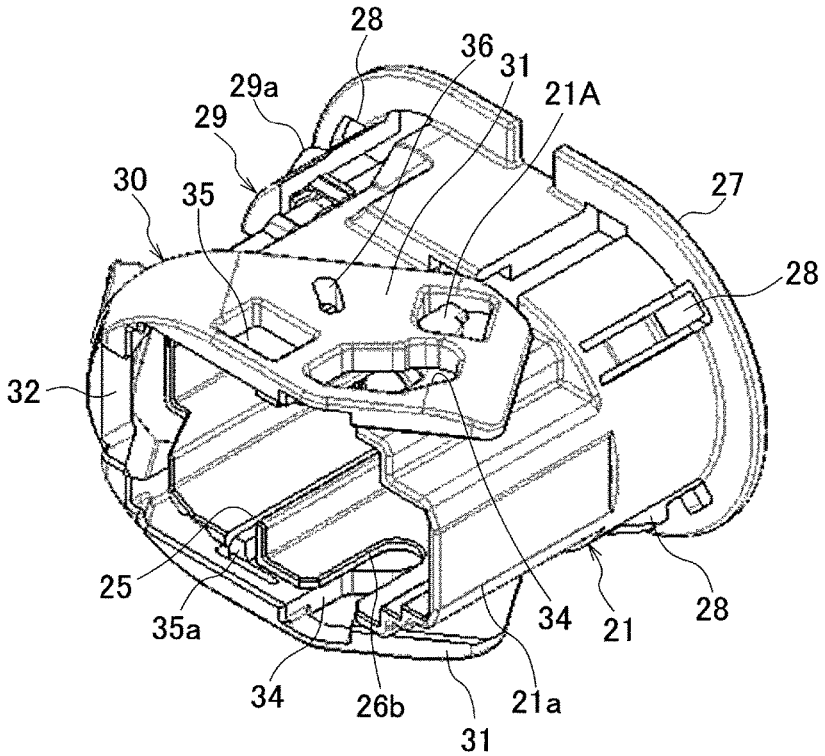
FIG. 7A is a perspective view of the male connector in which the lever according to the present embodiment is assembled and FIG. 7B is a sectional view of principal portions of the male connector.
Figure 7B:
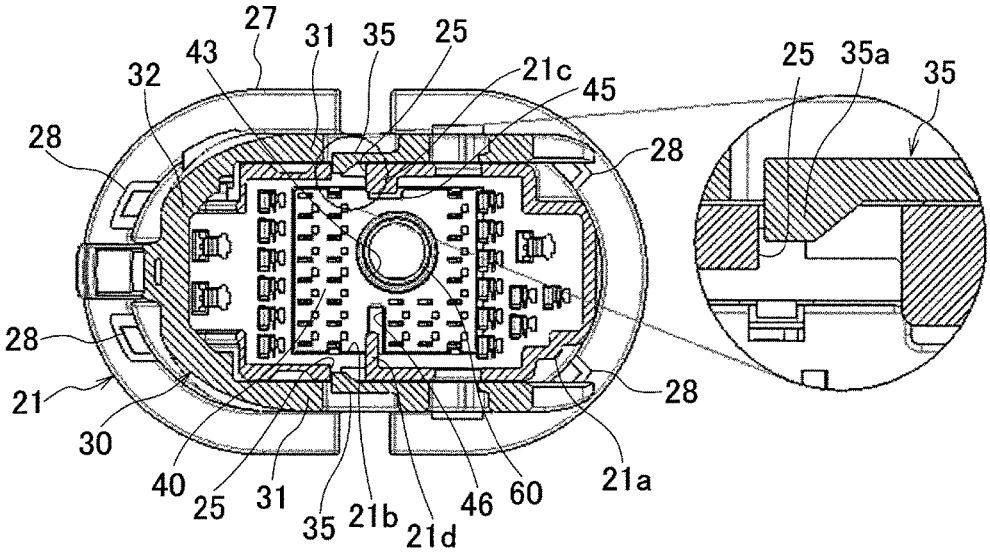
Figure 8A:
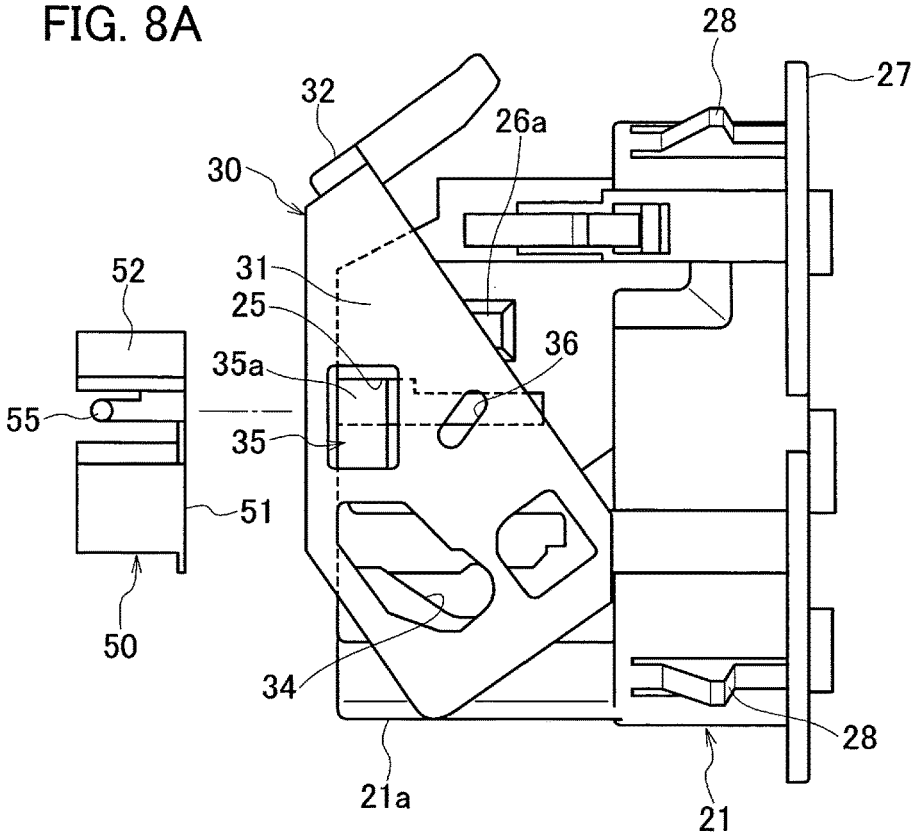
FIG. 8A is a side view of the male connector before the moving plate according to the present embodiment is assembled and FIG. 8B is a side view of the male connector in a lever temporary locking position in which the moving plate is assembled.
Figure 8B:
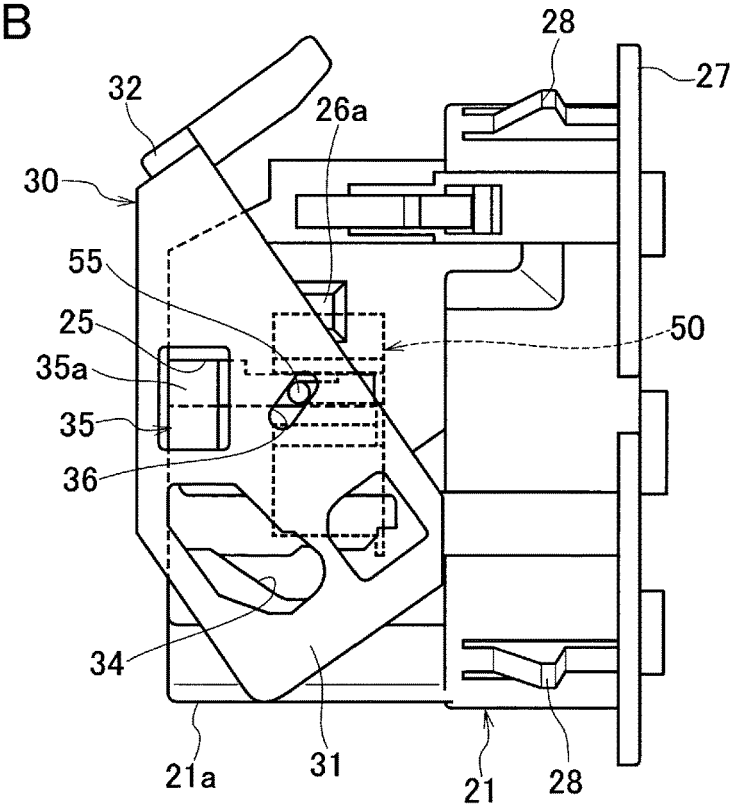
Figure 9:
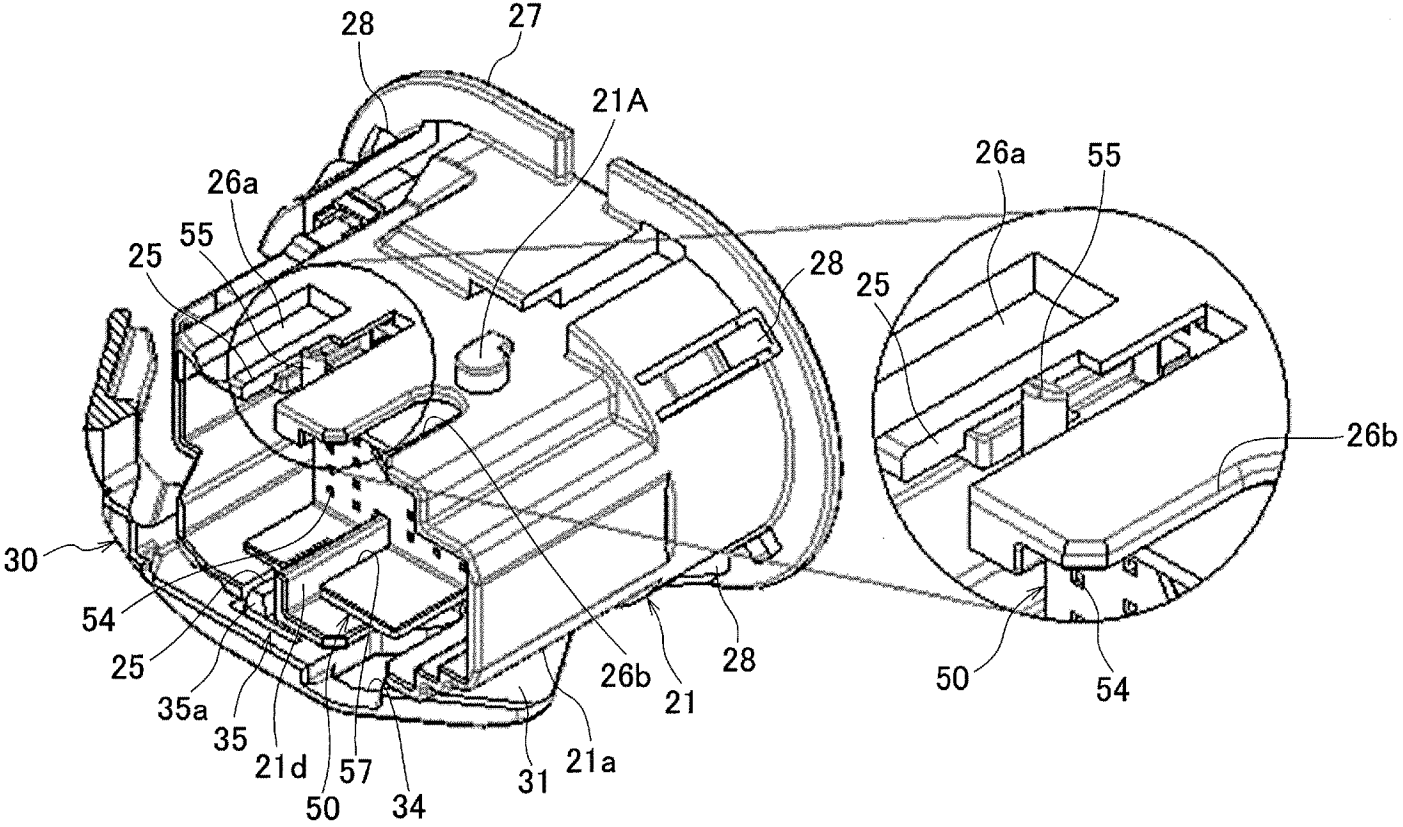
FIG. 9 is a perspective view of the male connector before the moving plate according to the present embodiment is moved.
Figure 10:
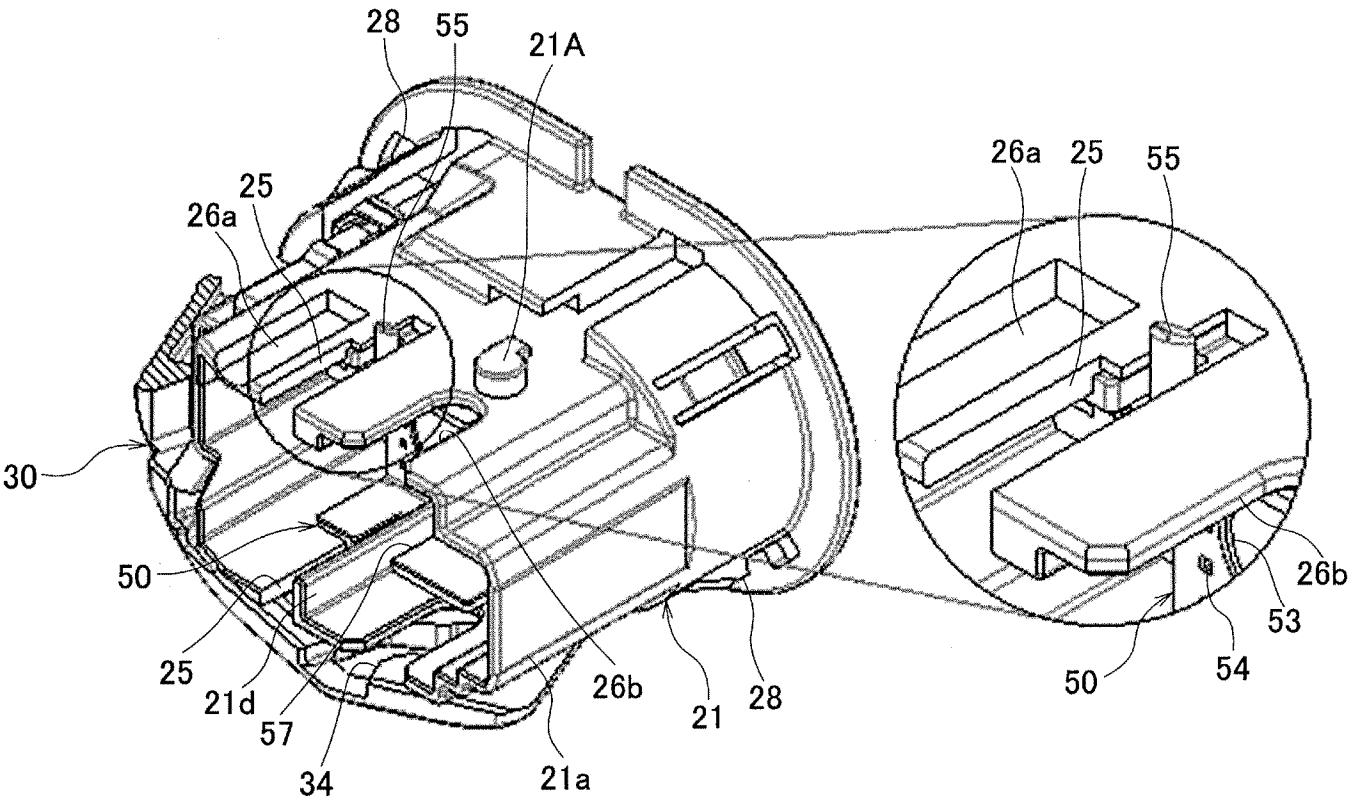
FIG. 10 is a perspective view of the male connector while the moving plate according to the present embodiment is moving.
Figure 11A:
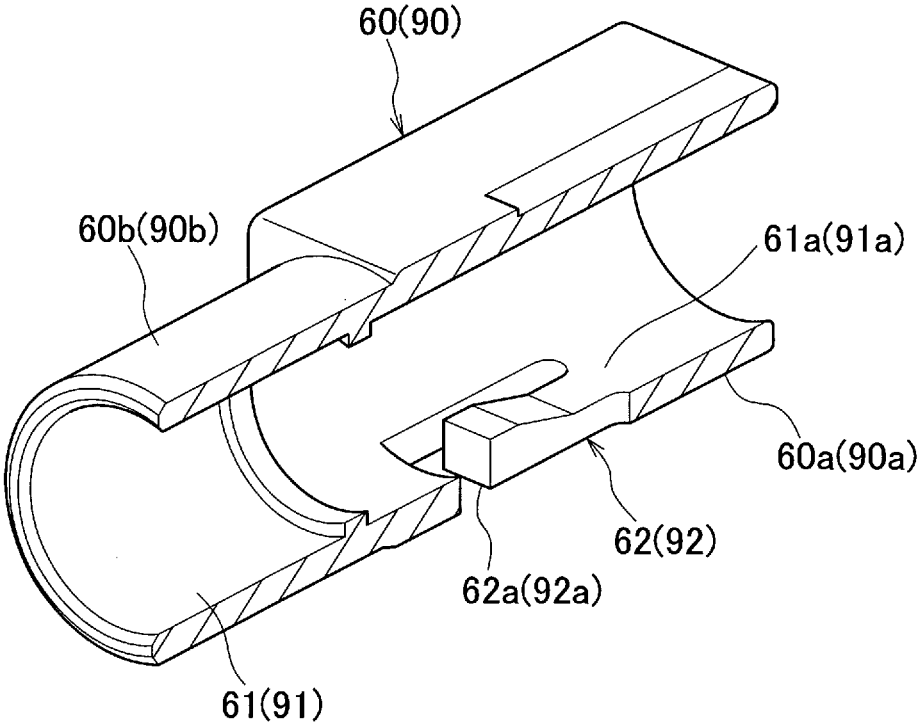
FIG. 11A is a perspective view showing principal portions of a sub-connector as a cross section and FIG. 11B is an enlarged sectional view of the principal portions of the sub-connector.
Figure 11B:
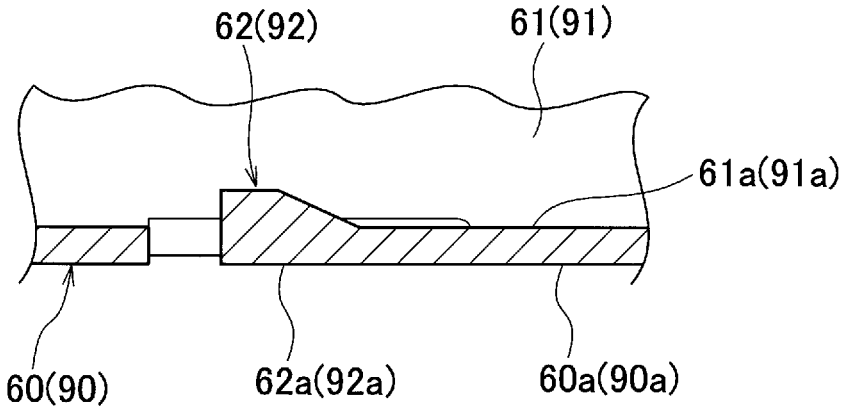
Figure 12A:
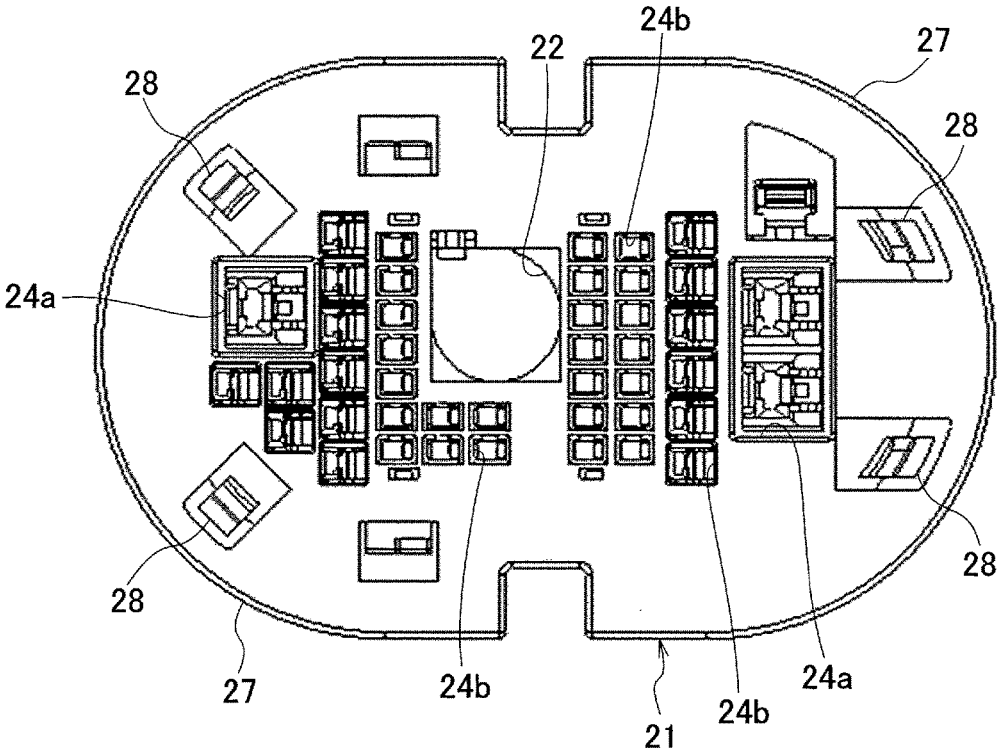
FIG. 12A is a rear view of the housing of the male connector according to the present embodiment and FIG. 12B is a partial perspective view of the principal portions.
Figure 12B:
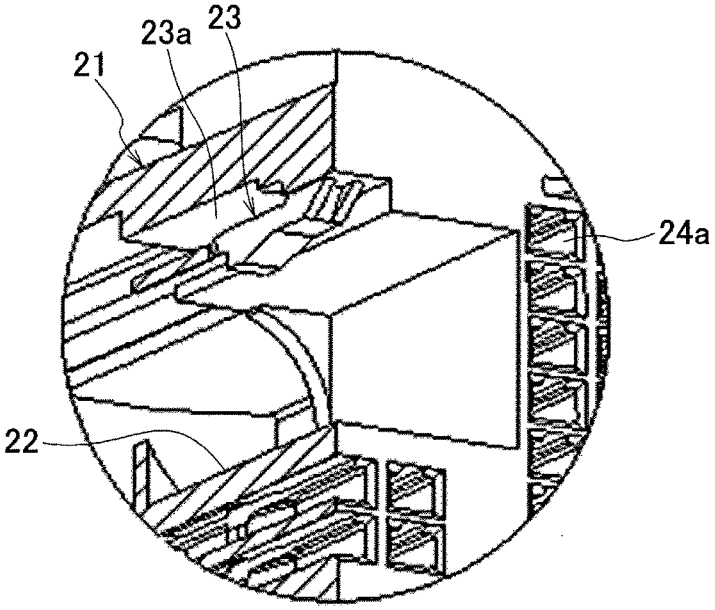
Figure 13:
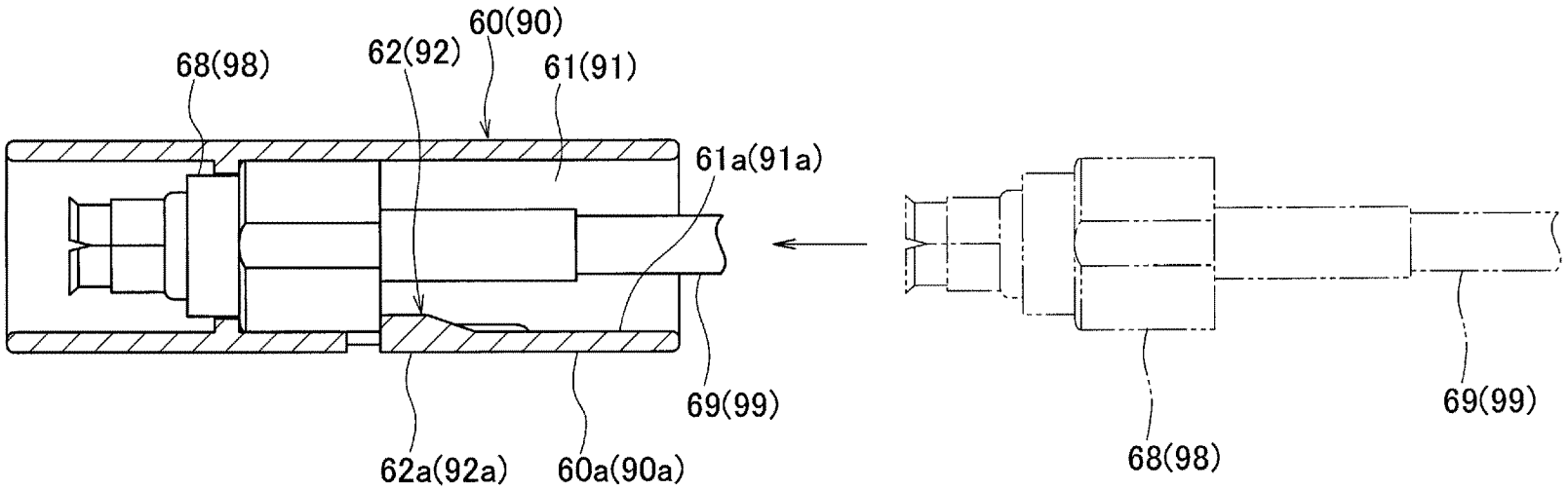
FIG. 13 is a sectional view showing a state in which a terminal is accommodated and held in a cavity of the sub-connector according to the present embodiment.
Figure 14:
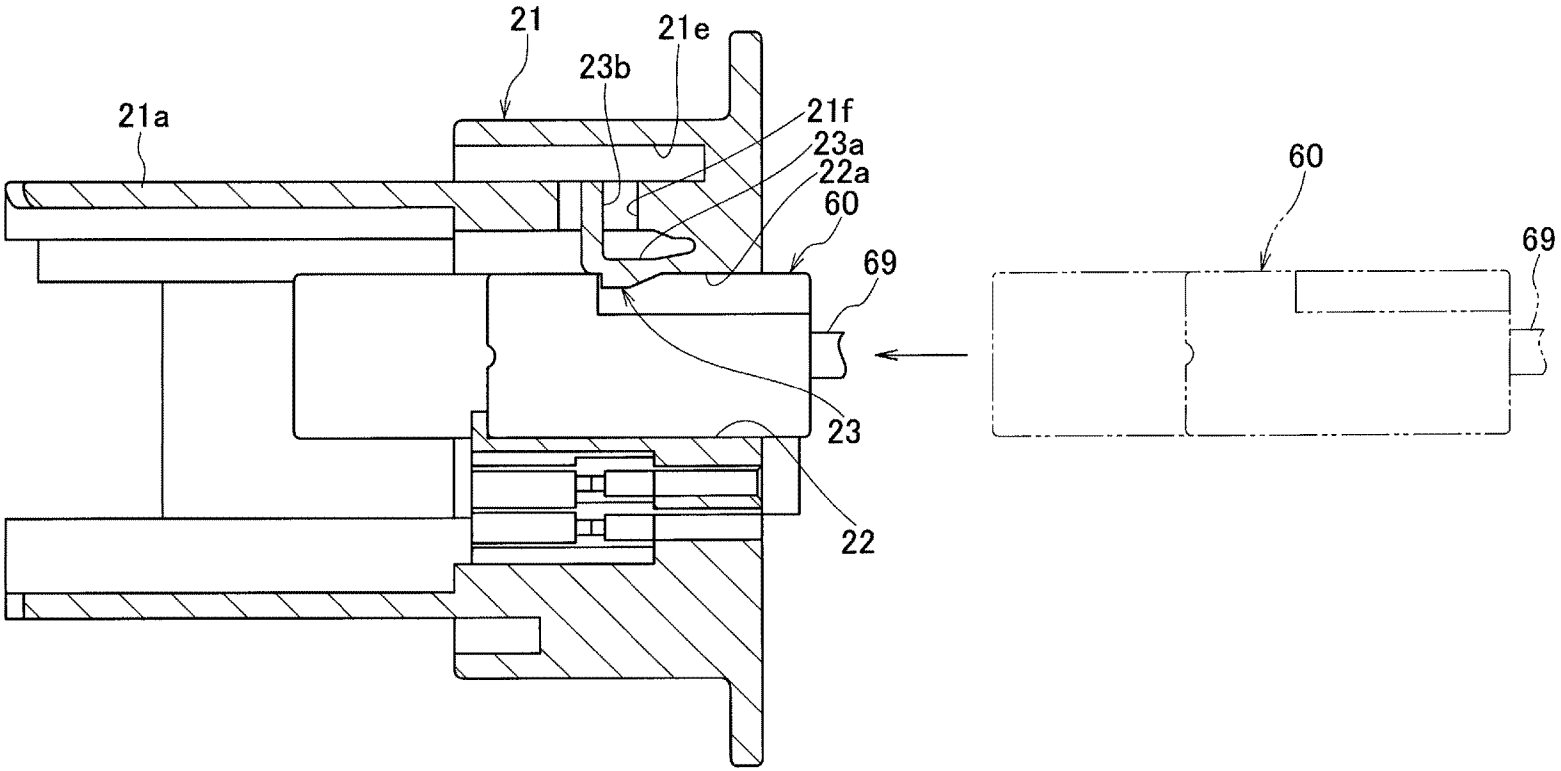
FIG. 14 is a sectional view showing a state in which the sub-connector is locked by a locking portion in a sub-connector accommodation hole of the housing according to the present embodiment.
Figure 15:
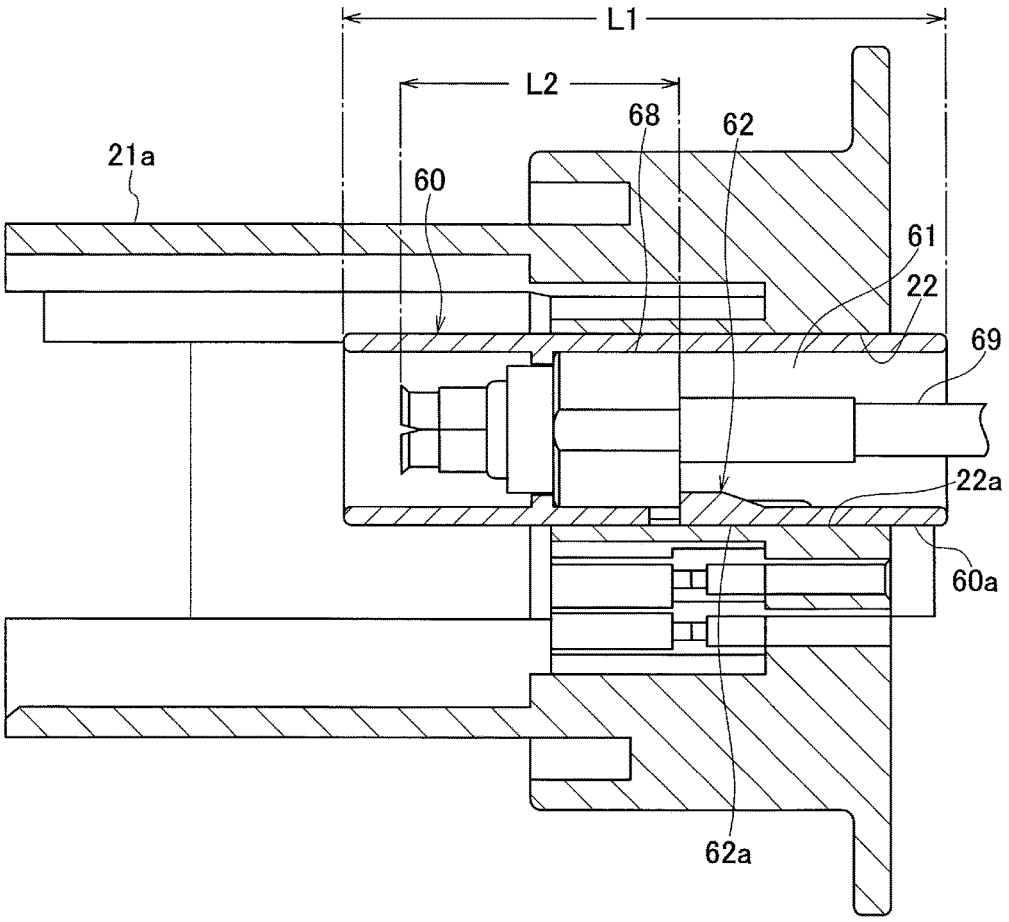
FIG. 15 is a sectional view showing a state in which the sub-connector inserted into the sub-connector accommodation hole according to the present embodiment is locked by a lance.
Figure 16:
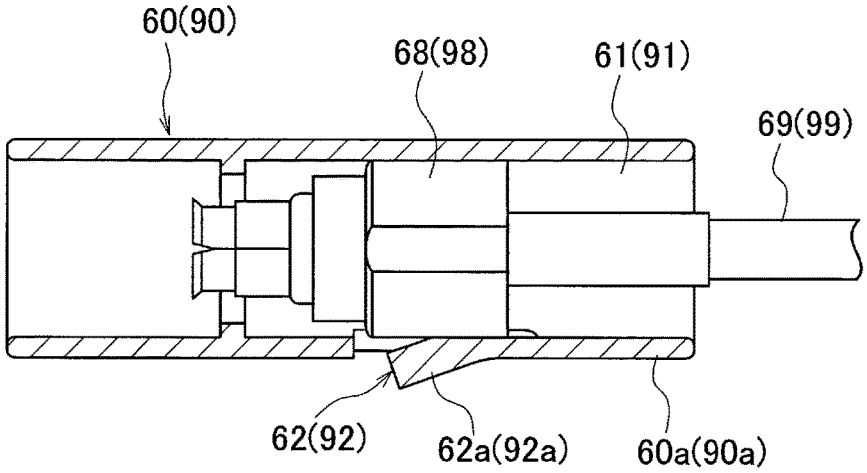
FIG. 16 is a sectional view showing a state in which the terminal is halfway inserted into the cavity of the sub-connector according to the present embodiment.
Figure 17:
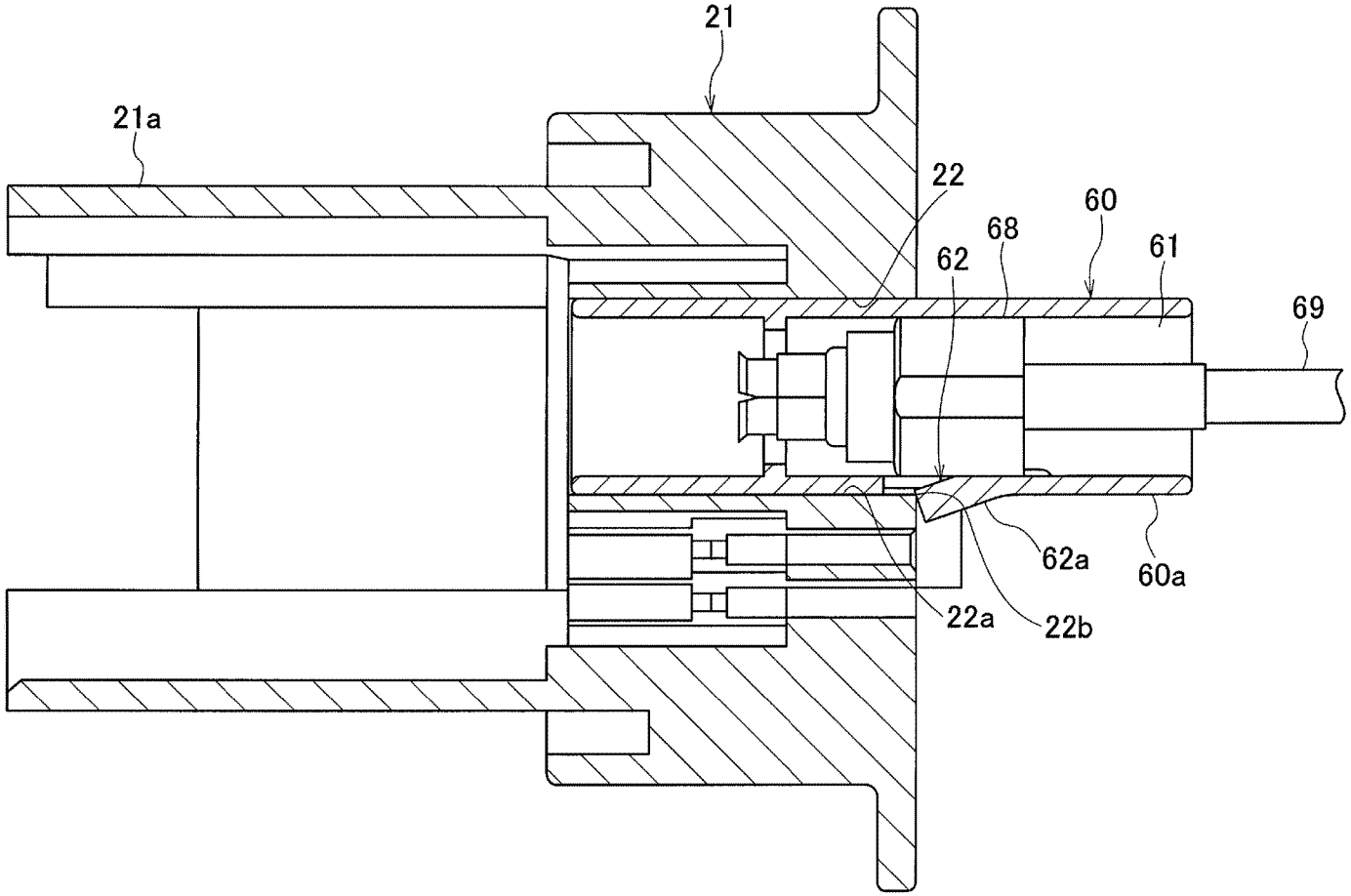
FIG. 17 is a sectional view showing a halfway inserted state of the sub-connector according to the present embodiment.
Figure 18:
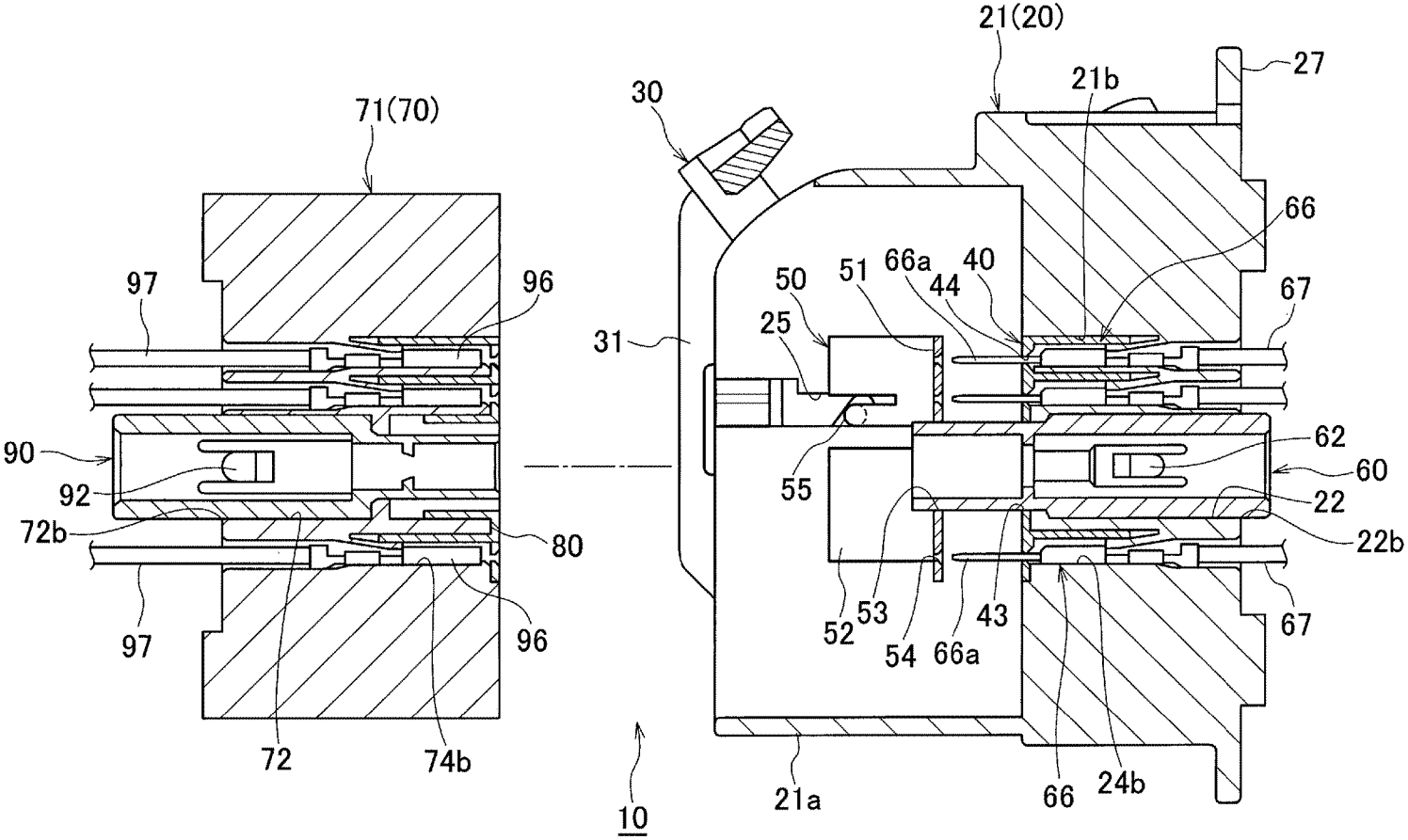
FIG. 18 is a sectional view showing a state before the male connector and the female connector according to the present embodiment are fitted.
Figure 19:
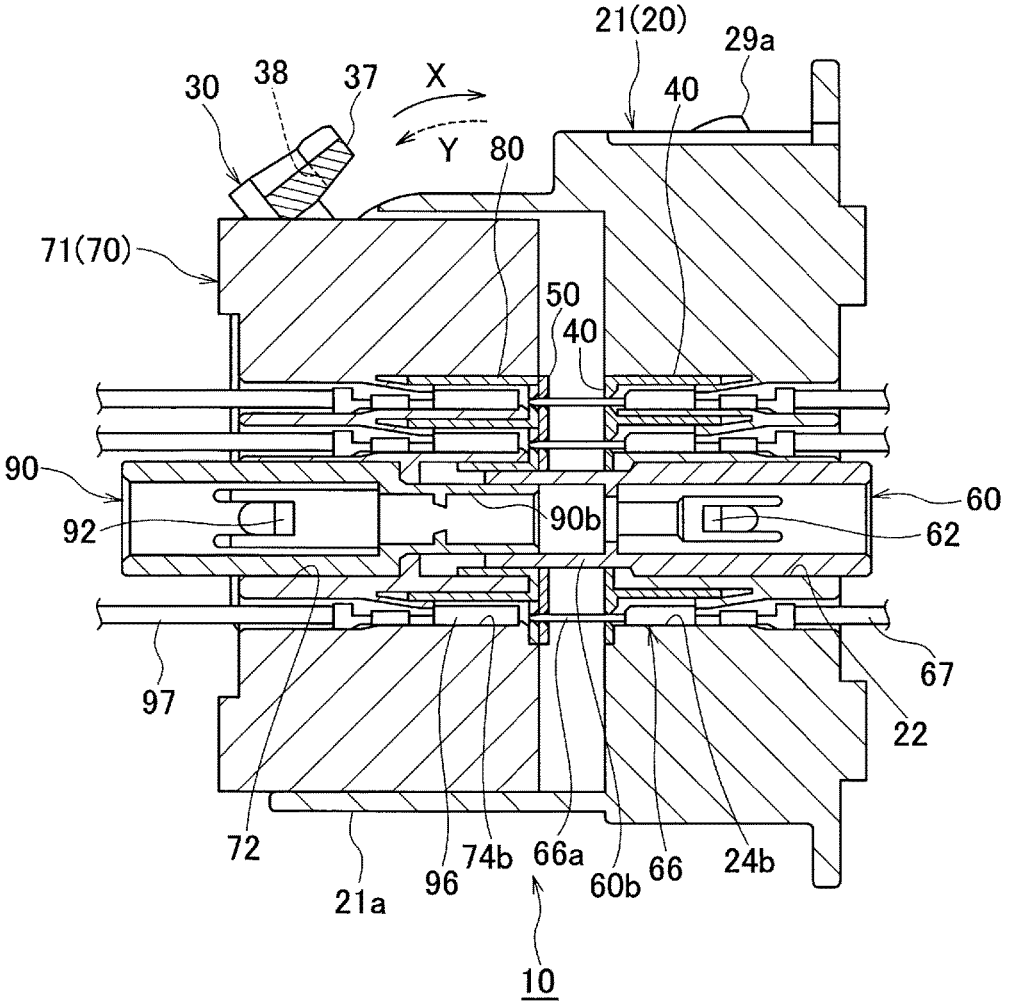
FIG. 19 is a sectional view showing a state in which the male connector and the female connector according to the present embodiment are halfway fitted.
Figure 20:
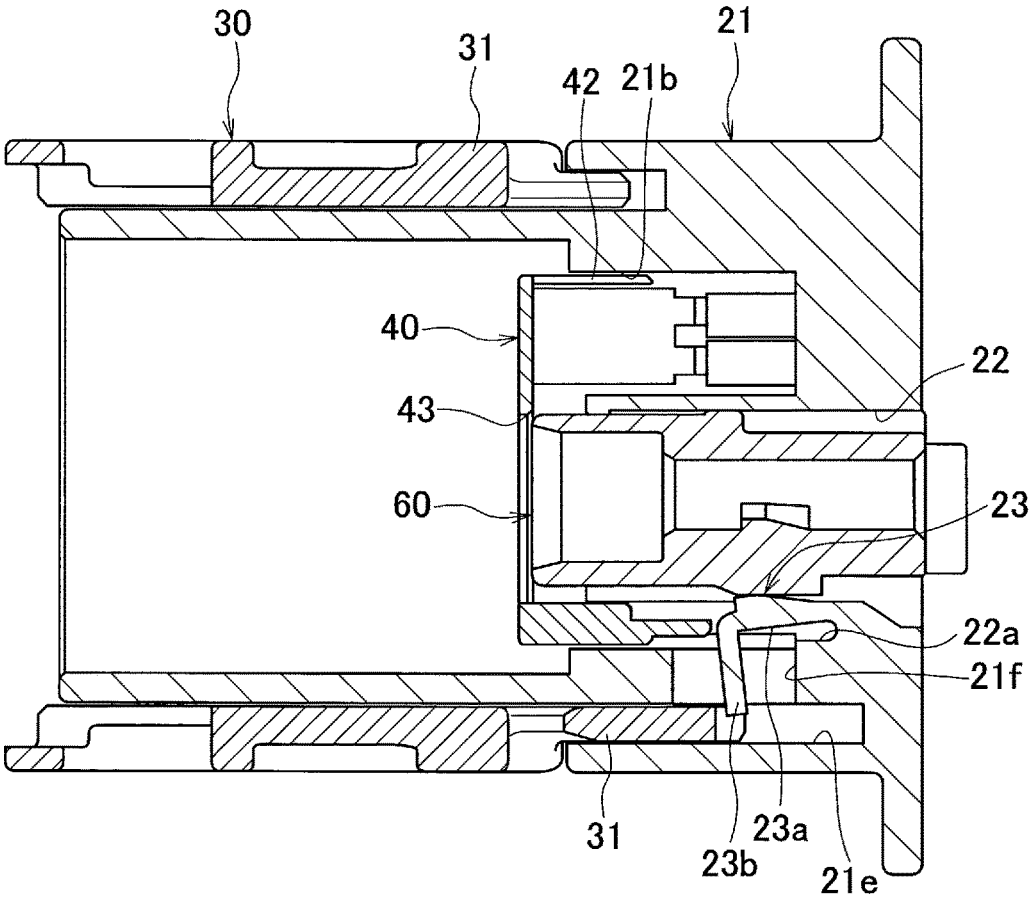
FIG. 20 is a sectional view showing a state in which the lever does not move due to half fitting of the sub-connector according to the present embodiment.
Figure 21:
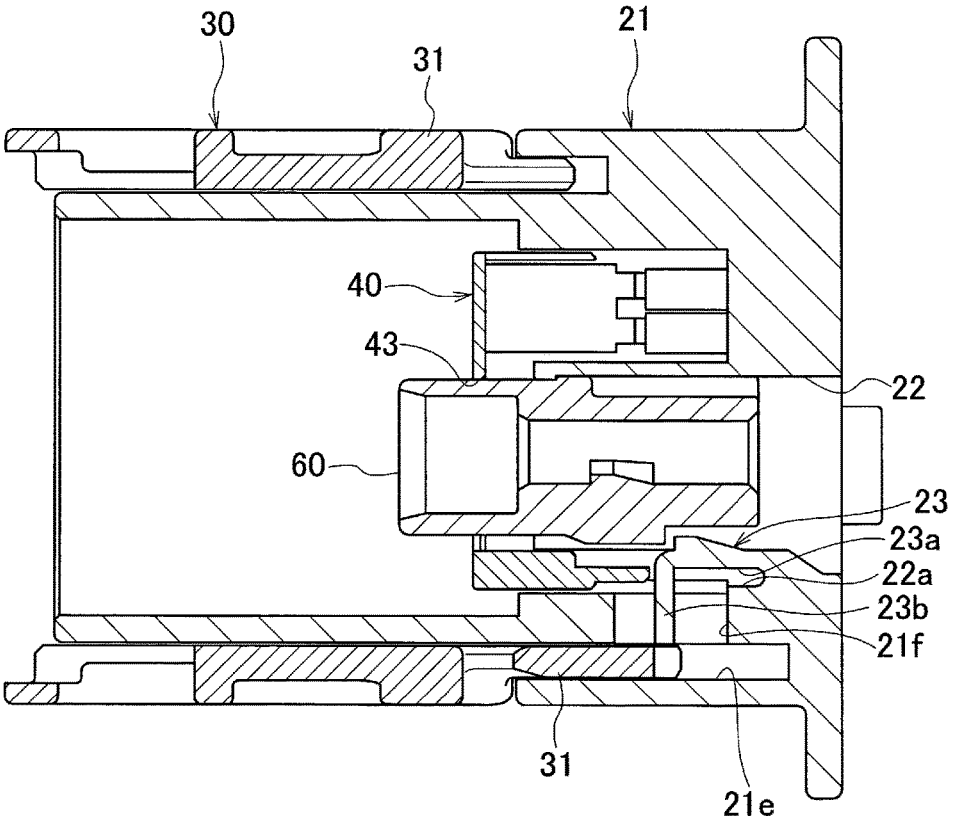
FIG. 21 is a sectional view showing a state in which the lever moves due to fitting of the sub-connector according to the present embodiment.
Figure 22:
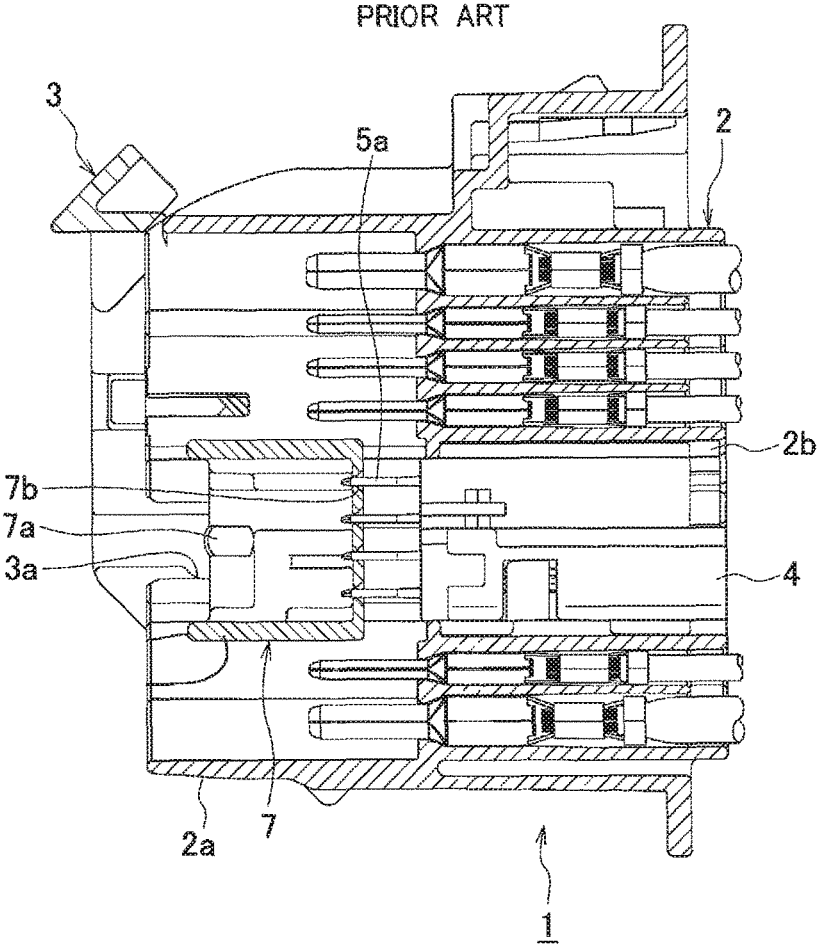
FIG. 22 PRIOR ART
FIG. 22 is a side sectional view of a conventional connector.
Figure 23:
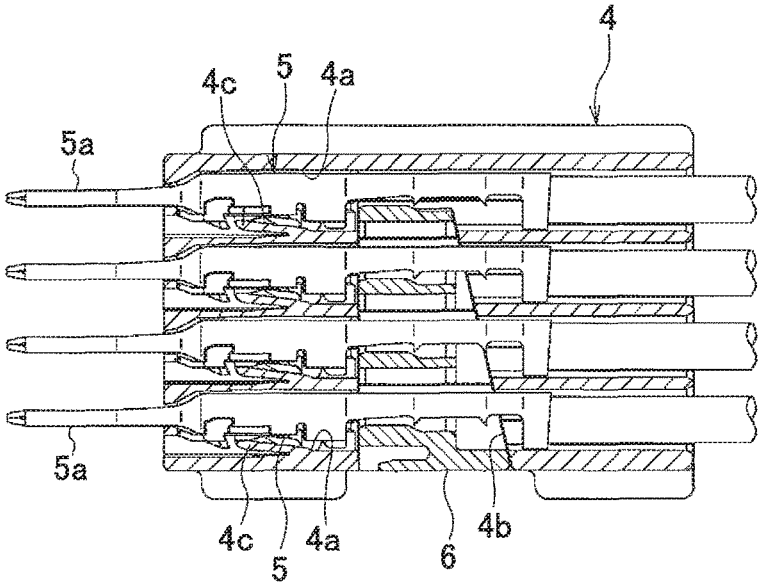
FIG. 23 PRIOR ART
FIG. 23 is a side sectional view of the sub-housing accommodating and holding a conventional male terminal.

FIG. 1 is a perspective view before connectors according to an embodiment of the present invention are fitted, FIG. 2 is an exploded perspective view of a male connector of the connectors, FIG. 3 is an exploded perspective view of a female connector of the connectors, FIG. 4 is a perspective view of a housing of the male connector, FIG. 5 is a perspective view of a lever of the male connector, FIG. 6 is a perspective view of a moving plate of the male connector, FIG. 7A is a perspective view of the male connector in which the lever is assembled, FIG. 7B is a sectional view of principal portions of the male connector, FIG. 8A is a side view of the male connector before the moving plate is assembled, FIG. 8B is a side view of the male connector in a lever temporary locking position in which the moving plate is assembled, FIG. 9 is a perspective view of the male connector before the moving plate is moved, FIG. 10 is a perspective view of the male connector while the moving plate is moving, FIG. 11A is a perspective view showing principal portions of a sub-connector as a cross section, FIG. 11B is an enlarged sectional view of the principal portions of the sub-connector, FIG. 12A is a rear view of the housing of the male connector, FIG. 12B is a partial perspective view of the principal portions, FIG. 13 is a sectional view showing a state in which a terminal is accommodated and held in a cavity of the sub-connector, FIG. 14 is a sectional view showing a state in which the sub-connector is locked by a locking portion in a sub-connector accommodation hole of the housing, FIG. 15 is a sectional view showing a state in which the sub-connector inserted into the sub-connector accommodation hole is locked by a lance, FIG. 16 is a sectional view showing a state in which the terminal is halfway inserted into the cavity of the sub-connector, FIG. 17 is a sectional view showing a halfway inserted state of the sub-connector, FIG. 18 is a sectional view showing a state before the male connector and the female connector are fitted, FIG. 19 is a sectional view showing a state in which the male connector and the female connector are halfway fitted, FIG. 20 is a sectional view showing a state in which the lever does not move due to half fitting of the sub-connector, and FIG. 21 is a sectional view showing a state in which the lever moves due to fitting of the sub-connector.

As shown in FIG. 1, a lever type connector 10 is made of a pair of male and female connectors 20, 70 that can be fitted into and detached from each other and is used as, for example, a front door connector of an automobile.

The male connector 20 includes, as shown in FIG. 2, a male housing 21 having a hood portion 21*a* with a tubular shaped and formed on the front side, a lever 30 rotatably supported by the male housing 21 via a spindle 21A, a front holder 40 on the male side mounted on the male housing 21, a moving plate 50 that positions a tab portion 66*a* of a male terminal 66 inside the hood portion 21*a*, and a male coaxial sub-connector 60 inserted into a sub-connector accommodation hole 22 formed in the male housing 21.

Also, as shown in FIG. 3, the female connector 70 includes a female housing 71 having a cam follower 75 engaged with a cam groove 34 formed in the lever 30 formed by being integrally projected and fitted into and detached from the hood portion 21*a* of the male housing 21, a front holder 80 on the female side mounted on the front side of the female housing 71, and a female coaxial sub-connector 90 inserted into a sub-connector accommodation hole 72 formed in the female housing 71. As shown in FIG. 19, a forward movement operation (indicated by a solid line arrow X in FIG. 19) of the lever 30 is performed while the cam follower 75 of the female housing 71 is engaged with the cam groove 34 of the lever 30, and thus the female housing 71 is moved to the back side in the hood portion 21*a* together with the moving plate 50 to be fitted into the male housing 21.

As shown in FIGS. 12 and 18, the male housing 21 is made of synthetic resin and has the sub-connector accommodation hole 22 storing the male coaxial sub-connector 60 formed from the center of the back surface thereof toward the hood portion 21*a* like passing through in the forward and backward direction. Also, as shown in FIG. 14, a locking portion 23 with flexibility locked by the male coaxial sub-connector 60 is formed on an inner wall 22*a* of the sub-connector accommodation hole 22 of the male housing 21 by being integrally projected. Further, as shown in FIGS. 20 and 21, a control portion 23*b* that inhibits a forward movement operation X of the lever 30 by being made lockable by the lever 30 and detachable therefrom is formed on the free end side of a bottom 23*a* of the locking portion 23 by being integrally projected. That is, as shown in FIGS. 20 and 21, the locking portion 23 locks the male coaxial sub-connector 60 only when the male coaxial sub-connector 60 is completely accommodated in the sub-connector accommodation hole 22 of the male housing 21 and when the male coaxial sub-connector 60 is in a halfway inserted state or a half fitted state, the locking portion 23 is pushed by the male coaxial sub-connector 60 and the control portion 23*b* of the locking portion 23 abuts against the tip of an arm portion 31 of the lever 30 to make the lever 30 unmovable so that the male coaxial sub-connector 60 cannot be locked. Incidentally, as shown in FIGS. 14, 20, and 21, the control portion 23*b* of the locking portion 23 is inserted into a communicating hole 21*f* communicating with a lever accommodation groove 21*e* accommodating a tip side of the arm portion 31 of the lever 30 of the male housing 21.

Also, as shown in FIGS. 12 and 18, a plurality of large and small terminal accommodation chambers 24*a*, 24*b* accommodating male terminals 64, 66 connected to terminals of wires 65, 67 for power supply circuits, signal circuits or the like is formed around the sub-connector accommodation hole 22 of the male housing 21 like passing through in the forward and backward direction.

As shown in FIGS. 1, 2, 4, and 8, a groove portion 25 in a notched shape for temporarily locking the lever 30 is formed in the center of each of both sidewalls of the hood portion 21*a* of the male housing 21. The pair of groove portions 25, 25 functions as a guiderail when a boss 55 of the moving plate 50 or one guide protrusion 76 of the female housing 71 moves. Further, receiving grooves 26*a*, 26*b* in recessed and notched shapes into which a locking protrusion 35*a* of an elastic locking piece 35 of the lever 30 and another guide protrusion 77 of the female housing 71 are inserted are formed respectively in positions sandwiching each of the groove portions 25 in both sidewalls of the hood portion 21*a*. Incidentally, when the lever 30 is temporarily locked as shown in FIG. 8B, the locking protrusion 35*a* of the elastic locking piece 35 of the lever 30 is locked into a groove surface of the groove portion 25 of the hood portion 21*a*.

A flange portion 27 in an annular plate shape is formed on an outer circumference of a rear end of the male housing 21 by being integrally projected. A recessed groove of an annular seal portion on the front side of a grommet made of rubber (not shown) is fitted into the flange portion 27 in an annular shape. Further, two pairs of locking protrusions 28, 28, each formed on upper side and lower side, are formed on the outer circumference of the rear end of the male housing 21 by being integrally projected. Then, if the male housing 21 is passed through a mounting hole of a panel of an automobile (not shown) from the door side, the lever type connector 10 is attached to the mounting hole of the panel in a sealed state via the annular seal portion on the front side of the grommet by the tips of each pair of the locking protrusions 28, 28 of the male housing 21 being locked by the surface on the body side around the mounting hole of the panel.

Further, as shown in FIGS. 4 and 19, an elastic locking piece 29 with a locking protrusion 29*a* projected therefrom is formed in the center on the upper side of the flange portion 27 of the male housing 21 by being integrally projected. The locking protrusion 29*a* is lockable into and detachable from a locking hole 38 formed in a protruding piece 37 of the lever 30.

As shown in FIGS. 1, 2, 5, 7A, and 7B, the lever 30 is integrally formed from a pair of the arm portions 31, 31 and an operation portion 32 linking the pair of arm portions 31, 31 using synthetic resin. Each of the arm portions 31 has a bearing hole 33 that rotatably supports each of the spindles 21A formed to protrude on upper side and lower side of the outer circumferential surface of the hood portion 21*a* of the male housing 21 by being integrally projected therefrom formed therein. Further, each of the arm portions 31 has a cam groove 34 engaged with the cam follower 75 formed in the female housing 71 formed therein. Then, as shown in FIG. 19, the male and female housings 21, 71 are fitted by a forward movement operation (indicated by a solid line arrow X in FIG. 19) of the operation portion 32 of the lever 30 via the cam groove 34 and the cam follower 75 using a weak insertion force and the male and female housings 21, 71 are detached by a backward movement operation (indicated by a dotted line arrow Y in FIG. 19) of the operation portion 32 of the lever 30 via the cam groove 34 and the cam follower 75 using a weak insertion force.

Each of the arm portions 31 has the elastic locking piece 35 with the locking protrusion 35*a* projected therefrom formed by notching. The lever 30 is held in a temporary locking position shown in FIG. 8B by the locking protrusion 35*a* of the elastic locking piece 35 being elastically locked into the groove surface of the groove portion 25 in a notched shape formed in the sidewall of the hood portion 21*a* of the male housing 21. Further, the lever 30 is held in a rotation control position by the locking protrusion 35*a* of the elastic locking piece 35 being elastically locked into the groove surface of the receiving groove 26*a* in a recessed shape formed in the sidewall of the hood portion 21*a* of the male housing 21.

Also, as shown in FIGS. 1, 2, 5, and 7, a slit 36 into which the boss 55 formed in the moving plate 50 is inserted in the temporary locking position shown in FIG. 8B is formed on each of the arm portions 31 of the lever 30 to move the moving plate 50 to the back side in the hood portion 21*a* by the forward movement operation X of the lever 30 together with the female housing 71. Further, as shown in FIGS. 5, and 19, the protruding piece 37 is formed in the center of the operation portion 32 of the lever 30 by being integrally projected. The protruding piece 37 has the locking hole 38 to lock the locking protrusion 29*a* of the elastic locking piece 29 of the male housing 21 formed therein.

As shown in FIGS. 2, 7B, and 18, the front holder 40 on the male side is made of synthetic resin and is formed in a rectangular box shape from a flat plate portion 41 and a circumferential wall portion 42. The circumferential wall portion 42 is held by being fitted into the sub-connector accommodation hole 22 of the male housing 21 and a recessed groove portion 21*b* in a rectangular shape formed around each of terminal accommodation chambers 24*a*, 24*b*. A sub-connector accommodation hole 43 that accommodates and holds the male coaxial sub-connector 60 is formed in the center of the flat plate portion 41 of the front holder 40. Also, a plurality of terminal accommodation holes 44 is formed in positions corresponding to a plurality of the terminal accommodation chambers 24*b* of the male housing 21 around the sub-connector accommodation hole 43 of the flat plate portion 41. Accordingly, in the front holder 40, the male terminal 66 connected to the end of the wire 67 is also accommodated and held in the plurality of terminal accommodation holes 44. Incidentally, a recess 45 inserted into a thick rib 21*c* of the hood portion 21*a* of the male housing 21 is formed on one side of the circumferential wall portion 42 and a slit 46 inserted into a thin rib 21*d* of the hood portion 21*a* of the male housing 21 is formed on the other side of the circumferential wall portion 42.

As shown in FIGS. 18 and 19, the moving plate 50 is made movable in a forward and backward direction between an initial position located on an opening side of the hood portion 21*a* of the male housing 21 and a fitting position located on the back side of the hood portion 21*a*. Also, as shown in FIGS. 2 and 6, the moving plate 50 is made of synthetic resin and integrally formed in a U shape from a plate main body 51 in a rectangular plate shape and both sidewall portions 52, 52 projecting forward from both side ends of the plate main body 51. The plate main body 51 has the sub-connector accommodation hole 53 formed in the center and also a plurality of positioning holes 54 lined up and formed therearound. The axis of the tab portion 66*a* is prevented from wobbling by the tip of the tab portion 66*a* of the male terminal 66 being inserted into the positioning hole 54 of the moving plate 50 in a positioning state. Also, the boss 55 inserted into the slit 36 of the lever 30 is formed on the upper front side of the sidewall portion 52 by being integrally projected. Incidentally, a wide slit 56 inserted into the thick rib 21*c* of the hood portion 21*a* of the male housing 21 is formed in one of the sidewall portions 52 and a narrow slit 57 inserted into the thin rib 21*d* of the hood portion 21*a* of the male housing 21 is formed in the other of the sidewall portions 52.

As shown in FIGS. 11, 13, and 15, the male coaxial sub-connector 60 is formed from synthetic resin in a substantial block shape long in the forward and backward direction and accommodated by being inserted into the sub-connector accommodation hole 22 of the male housing 21 from the backward direction. A cavity 61 that accommodates a coaxial terminal 68 of male type connected to the terminal of a coaxial line 69 is formed in the center of the male coaxial sub-connector 60. A lance 62 with flexibility to be locked with the coaxial terminal 68 is formed on an inner wall 61 a of the cavity 61 by notching and in the case of halfway insertion of the coaxial terminal 68 into the cavity 61, as shown in FIGS. 16 and 17, the lance 62 projects outward from the male coaxial sub-connector 60 to abut, at an angle, against an opening exterior edge 22*b* of the sub-connector accommodation hole 22 of the male housing 21. That is, an undersurface 62*a* of the lance 62 is in the same plane with the surface of the inner wall 22*a* of the sub-connector accommodation hole 22 when the insertion of the coaxial terminal 68 into the cavity 61 is completed and in the case of halfway insertion of the coaxial terminal 68 into the cavity 61, the undersurface 62*a* of the lance 62 is made to project outward from an outer circumferential surface 60*a* of the male coaxial sub-connector 60. Further, as shown in FIG. 15, a length L1 of the male coaxial sub-connector 60 is set longer than a length L2 of the coaxial terminal 68 of male type (L1>L2).

As shown in FIG. 3, the female housing 71 is formed from synthetic resin in a rectangular box shape and the sub-connector accommodation hole 72 accommodating the female coaxial sub-connector 90 is formed in a substantial center thereof like passing through in the forward and backward direction. Also, a plurality of large and small terminal accommodation chambers 74*a*, 74*b* accommodating female terminals 94, 96 connected to the terminal of wires 95, 97 for power supply circuit terminals, signal circuit terminals or the like are formed around the sub-connector accommodation hole 72 of the female housing 71 like passing through in the forward and backward direction. Further, the cam follower 75 like a pin engaged with the cam groove 34 of the lever 30 is formed in the substantial center on both side faces of the female housing 71 by being integrally projected. Further, a pair of the guide protrusions 76, 77 for each of the groove portion 25 in a notched shape and the receiving groove 26*b* in a notched shape of the hood portion 21*a* of the male housing 21 is formed in positions on both side faces of the female housing 71 sandwiching the cam follower 75 by being integrally projected.

As shown in FIG. 3, the front holder 80 on the female side is made of synthetic resin and is formed in a rectangular substantial box shape from a flat plate portion 81 and a circumferential wall portion 82. The circumferential wall portion 82 is held by being fitted into a recess 74 formed on the front face and the outer circumferential surface of the female housing 71. A sub-connector accommodation hole 83 that accommodates and holds the female coaxial sub-connector 90 is formed in the center of the flat plate portion 81 of the front holder 80. Also, a plurality of terminal accommodation holes 84 is formed in positions corresponding to a plurality of the terminal accommodation chambers 74*b* of the female housing 71 around the sub-connector accommodation hole 83 of the flat plate portion 81. Accordingly, in the front holder 80, the female terminal 96 connected to the end of the wire 97 is also accommodated and held in the plurality of terminal accommodation holes 84.

As shown in FIGS. 11 and 13, the female coaxial sub-connector 90 is formed from synthetic resin in a substantial block shape long in the forward and backward direction and accommodated by being inserted into the sub-connector accommodation hole 72 of the female housing 71 from the backward direction. A cavity 91 that accommodates a coaxial terminal 98 of female type connected to the terminal of a coaxial line 99 is formed in the center of the female coaxial sub-connector 90. A lance 92 with flexibility locked by the coaxial terminal 98 is formed on an inner wall 91*a* of the cavity 91 by notching and in the case of halfway insertion of the coaxial terminal 98 into the cavity 91, as shown in FIG. 16, the lance 92 projects outward from the female coaxial sub-connector 90 to abut, at an angle, against an opening exterior edge 72*b* of the sub-connector accommodation hole 72 of the female housing 71. That is, an undersurface 92*a* of the lance 92 is in the same plane with the surface of the inner wall 72*a* of the sub-connector accommodation hole 72 when the insertion of the coaxial terminal 98 into the cavity 91 is completed and in the case of halfway insertion of the coaxial terminal 98 into the cavity 91, the undersurface 92*a* of the lance 92 is made to project outward from an outer circumferential surface 90*a* of the female coaxial sub-connector 90.

According to the lever type connector 10 in the above embodiment, as shown in FIG. 13, with the lances 62, 92 with flexibility locked by the coaxial terminals 68, 98 of male/female type being formed by notching on the inner walls 61*a*, 91*a* of the cavities 61, 91 of the male/female coaxial sub-connectors 60, 90, when the male/female coaxial sub-connectors 60, 90 are assembled to the sub-connector accommodation holes 22, 72 of the male/female housings 21, 71 while the coaxial terminals 68, 98 are inserted, as shown in FIG. 15, the inner walls 22*a*, 72*a* of the sub-connector accommodation holes 22, 72 of the male/female housings 21, 71 are located immediately below the lances 62, 92 with flexibility of the male/female coaxial sub-connectors 60, 90 and thus, double locking (double locking by the lances 62, 92 and by pushing the lances 62, 92 through the inner walls 22*a*, 72*a* of the sub-connector accommodation holes 22, 72) of the coaxial terminals 68, 98 can be implemented by preventing the lances 62, 92 from being displaced below.

Also, in the case of, as shown in FIG. 16, halfway insertion of the coaxial terminals 68, 98 into the cavities 61, 91, the lances 62, 92 remain to be bent and the undersurfaces 62*a*, 92*a* of the lances 62, 92 project outward from the male/female coaxial sub-connectors 60, 90. If an attempt is made to insert the male/female coaxial sub-connectors 60, 90 into the sub-connector accommodation holes 22, 72 of the male/female housings 21, 71 while the coaxial terminals 68, 98 are halfway inserted, as shown in FIG. 17, the halfway insertion of the coaxial terminals 68, 98 is detected by the abutment of the lances 62, 92 projecting from the outer circumferential surfaces 60*a*, 90*a* of the male/female coaxial sub-connectors 60, 90, at an angle, on the opening exterior edges 22*b*, 72*b* of the sub-connector accommodation holes 22, 72 of the male/female housings 21, 71.

By setting the undersurfaces 62*a*, 92*a* of the lances 62, 92 in the same plane with the surface of the inner walls 22*a*, 72*a* of the sub-connector accommodation holes 22, 72 when the insertion of the coaxial terminals 68, 98 of male/female type into the cavities 61, 91 of the male/female coaxial sub-connectors 60, 90 is completed and in the case of halfway insertion of the coaxial terminals 68, 98 into the cavities 61, 91, making the undersurfaces 62*a*, 92*a* of the lances 62, 92 project outward from the outer circumferential surfaces 60*a*, 90*a* of the male/female coaxial sub-connectors 60, 90, double locking of the coaxial terminals 68, 98 assembled to the male/female coaxial sub-connectors 60, 90 by the male/female housings 21, 71 can easily and reliably be implemented and also the halfway insertion of the coaxial terminals 68, 98 can easily and reliably be detected. Accordingly, a separate component for double locking of the terminal such as a conventional retainer is no longer needed so that lower costs can be achieved by reducing the number of components correspondingly.

Also, according to the lever type connector 10, the male housing 21 having the hood portion 21*a*, the lever 30 rotatably supported by the male housing 21 via the spindle 21A, the moving plate 50 that positions the tab portion 66*a* of the male terminal 66 inside the hood portion 21*a*, and female housing 71 fitted into or detached from the hood portion 21*a* are included, a forward movement operation (indicated by a solid line arrow X in FIG. 19) of the lever 30 is performed while the cam follower 75 formed in the female housing 71 is engaged with the cam groove 34 formed in the lever 30, the female housing 71 is moved to the back side in the hood portion 21*a* together with the moving plate 50 to be freely fitted into the male housing 21, the groove portion 25 for temporarily locking the lever 30 is formed in the hood portion 21*a*, and the groove portion 25 is used as a guiderail for moving the moving plate 50 and therefore, as shown in FIGS. 8A and 9, when the moving plate 50 is assembled into the hood portion 21*a* of the male housing 21, the boss 55 of the moving plate 50 can be moved along and assembled to the groove portion 25 used for temporarily locking the lever 30. Also, as shown in FIGS. 8B and 10, when the moving plate 50 is moved into the hood portion 21*a* of the male housing 21 by the forward movement operation X of the lever 30, the groove portion 25 used for temporarily locking the lever 30 can be used as a guiderail of the boss 55 of the moving plate 50.

By using the groove portion 25 used for temporarily locking the lever 30 as a guiderail of the moving plate 50 when the moving plate 50 is mounted or the lever 30 is operated, miniaturization of the lever type connector 10, assemblability of the moving plate 50, and operability of the moving plate 50 by the lever 30 can be improved.

Also, by setting, as shown in FIGS. 15 and 18, the length L1 of the male coaxial sub-connector 60 longer than the length L2 of the coaxial terminal 68 of male type, the tip of a cylindrical portion 60*b* of the male coaxial sub-connector 60 reaches the tip of a cylindrical portion 90*b* of the female coaxial sub-connector 90 earlier than the coaxial terminal 68 even if the female housing 71 is inserted into the hood portion 21*a* of the male housing 21 obliquely or in a direction in which prying is caused and, as shown in FIG. 19, the cylindrical portion 90*b* of the female coaxial sub-connector 90 is fitted into the cylindrical portion 60*b* of the male coaxial sub-connector 60 and so the occurrence of prying can be inhibited. Further, by making the length of the male coaxial sub-connector 60 longer, the male coaxial sub-connector 60 serves as a guide of the female housing 71 when the male/female housings 21, 71 are fitted, achieving an effect of inhibiting the occurrence of prying. By prolonging and adjusting the length of the tip of the male coaxial sub-connector 60 as described above, a prying inhibition function and a guide function can be provided. Because the number of components is unchanged, the cost can be reduced.

Further, by forming, as shown in FIGS. 20 and 21, the locking portion 23 with flexibility locked by the male sub-connector 60 on the inner wall 22*a* of the sub-connector accommodation hole 22 of the male housing 21 by being integrally projected and the control portion 23*b* that inhibits the forward movement operation X of the lever 30 by the lever 30 being made lockable/detachable on the free end side of the bottom 23*a* of the locking portion 23 by being integrally projected, in the case of halfway insertion of the male coaxial sub-connector 60 into the sub-connector accommodation hole 22 of the male housing 21, the locking portion 23 is pushed by the male coaxial sub-connector 60 and the control portion 23*b* of the locking portion 23 abuts against the tip of the arm portion 31 of the lever 30 so that the movement of the lever 30 can be inhibited. Accordingly, a half fitted state of the male coaxial sub-connector 60 and wrong connector fitting can easily and reliably be detected without adding any component.

Also according to the above embodiment, the lever type is adopted for the connector, but the above embodiment can also be applied to a connector that is not of the lever type, as a matter of course.

What is claimed is:

1. A connector comprising:

a housing having a sub-connector accommodation hole passing through in a forward and backward direction; and a sub-connector having a cavity passing through in the forward and backward direction and assembled by being inserted into the sub-connector accommodation hole of the housing from a backward direction while a terminal connected to a wire being inserted into the cavity, wherein a lance with flexibility to be locked with the terminal is formed on an inner wall of the cavity and in response to a halfway insertion of the terminal into the cavity, the lance projects outward from the sub-connector to abut, at an angle, against an opening exterior edge of the sub-connector accommodation hole.

2. The connector according to claim 1, wherein in response to a complete insertion of the terminal into the cavity, an undersurface of the lance is in the same plane with a surface of an inner wall of the housing forming the sub-connector accommodation hole, and in response to the halfway insertion of the terminal into the cavity, the undersurface of the lance projects outward from an outer circumferential surface of the sub-connector.

3. The connector according to claim 1, further comprising:

a male housing as the housing to accommodate and hold a male terminal as the terminal and having a hood portion;

a lever rotatably supported by the housing via a spindle;

a moving plate that positions a tab portion of the male terminal inside the hood portion; and a female housing as the housing to accommodate and hold a female terminal as the terminal and fitted into or detached from the hood portion, wherein the lever is caused to perform a forward movement operation while a cam follower formed in the female housing is fitted into a cam groove formed in the lever to move the female housing to a back side in the hood portion together with the moving plate to be freely fitted into the male housing and a groove portion for temporarily locking the lever is formed in the hood portion and the groove portion is used as a guiderail for moving the moving plate.

4. The connector according to claim 1, wherein a length of a male sub-connector as the sub-connector is set longer than that of a male terminal as the terminal.

5. The connector according to claim 3, wherein a length of a male sub-connector as the sub-connector is set longer than that of the male terminal.

6. The connector according to claim 3, wherein a locking portion with flexibility locked by a male sub-connector as the sub-connector is formed on an inner wall of the sub-connector accommodation hole of the male housing and a control portion that inhibits a forward movement operation of the lever by the lever being made lockable/detachable is formed on a free end side of the locking portion.

* * * * *